US006913828B2

(12) United States Patent
Zabetakis

(10) Patent No.: US 6,913,828 B2
(45) Date of Patent: Jul. 5, 2005

(54) PRODUCTION OF HOLLOW METAL MICROCYLINDERS FROM LIPIDS

(75) Inventor: Dan Zabetakis, College Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 122 days.

(21) Appl. No.: 10/081,901

(22) Filed: Mar. 5, 2002

(65) Prior Publication Data

US 2002/0100574 A1 Aug. 1, 2002

Related U.S. Application Data

(62) Division of application No. 09/450,439, filed on Nov. 30, 1999, now Pat. No. 6,382,299.

(51) Int. Cl.[7] ..... B22C 1/00; B22C 9/00

(52) U.S. Cl. ..... 428/402.2; 428/402.24; 428/586; 428/34.1

(58) Field of Search ..... 428/402.2, 402.24, 428/586, 34.1

(56) References Cited

U.S. PATENT DOCUMENTS

| | | | | |
|---|---|---|---|---|
| 4,877,501 A | | 10/1989 | Schnur et al. | |
| 4,911,981 A | * | 3/1990 | Schnur et al. | 428/402.24 |
| 4,990,291 A | | 2/1991 | Schoen et al. | |
| 5,096,551 A | | 3/1992 | Schoen et al. | |
| 5,492,696 A | | 2/1996 | Price et al. | |
| 5,814,414 A | * | 9/1998 | Georger, Jr. et al. | 428/586 |
| 6,013,206 A | | 1/2000 | Price et al. | |
| 6,382,299 B1 | * | 5/2002 | Zabetakis | 164/138 |

OTHER PUBLICATIONS

B.R. Ratna, S. Baral–Tosh, B. Kahn, J.M. Schnur, A.S. Rudolph, Effect Of Alcohol Chain Length On Tubule Formation In 1, 2–Bis(10, 12–Tricosadiynoyl)–sn–glycero–3–phosphocholine, Chemistry And Physics Of Lipids, 63 (1992) 47–53, Elsevier Scientific Publishers Ireland Ltd. No month.

G.M. Chow, W.B. Stockton, R. Price, S. Baral, A.C. Ting, B.R. Ratna, P.E. Shoen, J.M. Schnur, G.L. Bergeron, M.A. Czarnaski, J.J. Hickman, D.A. Kirkpatrick, Fabrication Of Biologically Based Microstructure Composites For Vacuum Field Emission, Materials Science And Engineering, A158 (1992), 1–6. No month.

S.L. Browning, J. Lodge, R.R. Price, J. Schelleng, P.E. Schoen, D. Zabetakis, Fabrication And Radio Frequency Charaterization Of High Dilectric Loss Tubule–Based Composites Near Percolation, Journal Of Applied Physics, vol. 84, No. 11, Dec. 1, 1998, 6109–6113.

* cited by examiner

*Primary Examiner*—Deborah Jones
*Assistant Examiner*—Vivek Koppikar
(74) *Attorney, Agent, or Firm*—John J. Karasek; George A. Kap

(57) ABSTRACT

Process for making metallic microcylinders from pre-treated diacetylenic lipid tubules which includes placing the tubules into an electroless plating bath containing a metal plating reagent, depositing by electroless plating on the surfaces of the tubules enough of a metal to make the tubules electrically conducting, separating the tubules from the plating bath, treating the tubules to remove the lipid and form the metal microcylinders, washing and drying the microcylinders to produce the metal microcylinders having aspect radio of about 12, weight average length of about 20$\mu$, weight average outside diameter of about 1.5$\mu$, and weight average wall thickness of about a quarter of one micron.

3 Claims, 3 Drawing Sheets

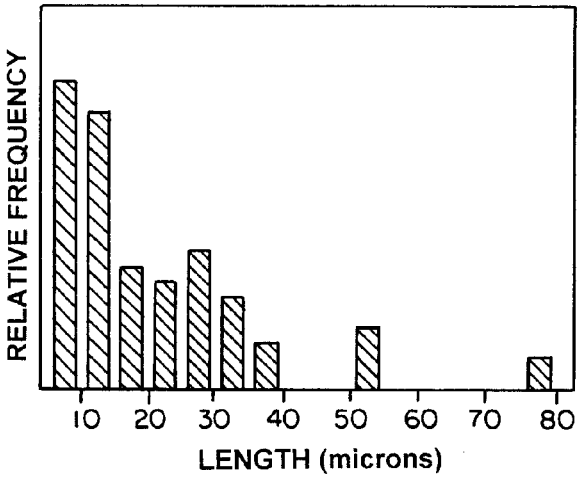
FIG. 2A
FIG. 2B
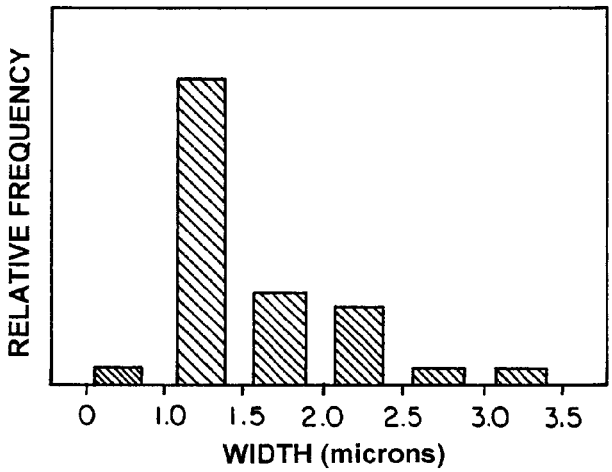
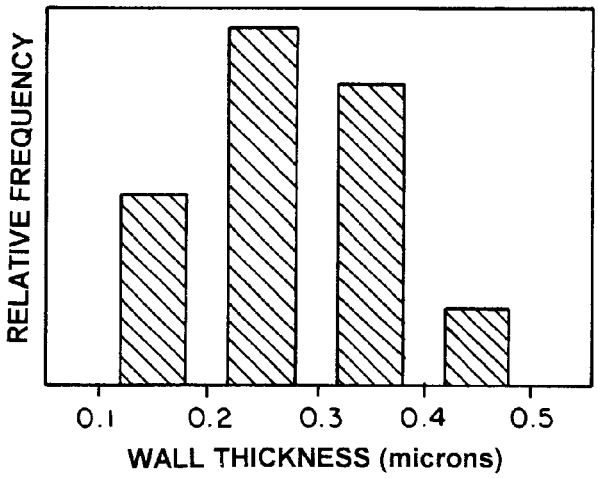
FIG. 2C

PRODUCTION OF HOLLOW METAL MICROCYLINDERS FROM LIPIDS

This is a divisional application of Ser. No. 09/450,439 filed Nov. 30, 1999 now U.S. Pat. No. 6,382,299.

BACKGROUND OF THE INVENTION

1. Field of the Invention

This invention pertains to hollow metal microcylinders produced from diacetylenic lipids by self-assembly and to a process for making same.

2. Description of Related Art

Organic tubules formed from a diacetylenic lipid by self-assembly were first publicly described in 1984 and achieved by a process of lipsomomal cooling. The lipid, i.e., 1,2-bis(10,12-tricosadiynoyll)-sn-glycero-3-phosphocholin (DC-8,9-PC), was heated in water above 50° C. and cooled. Upon cooling below the melting temperature of 42° C., the liposomes were observed to convert to tubules of sub-micron diameter by self-assembly. Later it was demonstrated how the tubules could be generated from the same lipid by the addition of water as a non-solvent to a solution of the lipid in alcohol or propylene glycol. The tubules were allowed to grow for periods up to 6 months and resulted in average lengths of up to 100 microns. Still later, the role of alcohols in tubule formation was further investigated. The lipid, i.e., DC-8,9-PC, in alcohol/water solutions, was heated to 60° C. and tubules were formed by cooling to room temperature. The solvent 85% methanol was found to yield tubules with the greatest lengths with an average of 65 microns.

Preparation of metallized derivatives from lipid tubules was reported in 1987. Permalloy-coated tubules have been used in composites to produce high-dielectric, low-loss materials by aligning the tubules with a magnetic field and similar technique was used to produce composites with significant ferromagnetic properties. The prior art tubules were not electrically conducting probably due to the fact that electroless metal plating was conducted to the point when bubbling commenced indicating that the bath was not exhausted and an insufficient amount of metal was plated on the tubules. A successful application of this technology was demonstrated in 1992 by aligning metallized tubules in a magnetic field and cast in epoxy. Subsequently, the epoxy was etched away and the surface sputter-coated with gold. This structure was used to show a very low vacuum field emission of less than 10$\mu$A.

Progress in the application of tubule technology has been held back by the non-uniformity and incompleteness of the metal coating. Further, the coating consisted in a large part of metals and metallic oxides, such as nickel and nickel oxides, rather than a metallic alloy, such as nickel alloy.

OBJECTS AND BRIEF SUMMARY OF THE INVENTION

An object of this invention is a process for making hollow metal microcylinders from diacetylenic lipids by self-assembly characterized by using as received technical grade diacetylenic lipids without preliminary purification, resulting in a more efficient use of lipids.

Another object of this invention is hollow metal microcylinders in free-flowing powder form.

Another aspect of the invention is the electrically conductive metal microcylinders.

Another object of this invention is electrically conducting metal microcylinders made from a diacetylenic lipid by self-assembly which are devoid of the lipid.

These and other objects of this invention can be achieved by making the microcylinders from diacetylenic lipids by self assembly thereof to produce lipid tubules, and then metallizing these tubules by plating at least one metal thereon to make the metallized tubules and then metal microcylinders which are electrically conducting and/or magnetically sensitive.

DETAILED DESCRIPTION OF THE INVENTION

Figure 1:
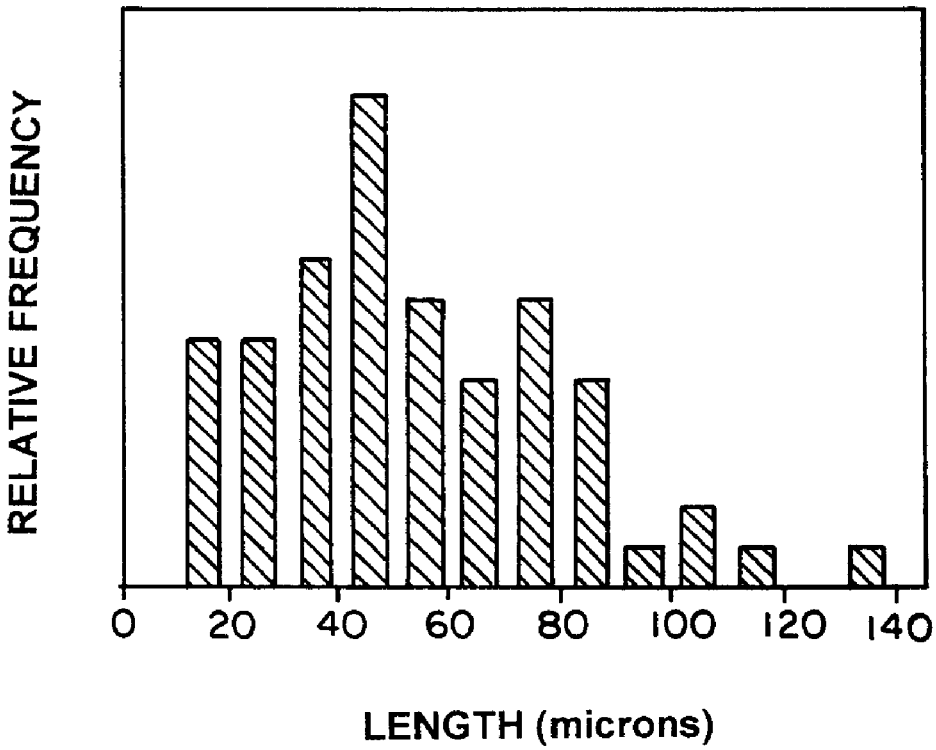
FIG. 1 is a histogram of lengths of the DC-8,9-PC lipid tubules precipitated from 70% ethanol.

This invention pertains to a process for preparing metal microcylinders and to the metal microcylinders produced thereby.

An application for the metal microcylinders of this invention is in a plastic sheet used in antenna isolation for weight reduction and electrical properties wherein amount of the metal microcylinders in the plastic sheet is below the percolation threshold. Another application is in stealth components which absorb radiation, where amount of the metal microcylinders is at about the percolation threshold.

Adding electrically conductive particles to an insulating polymer increases the permittivity and conductivity of the resulting composite. When sufficient particles have been loaded, the composite will itself begin to conduct electricity over macroscopic distances. The onset of this transformation is called percolation.

Process for making the metal microcylinders of this invention is characterized by the use of technical grade diacetylinic lipids which do not require a preliminary purification, and by electroless plating in a plating bath of self-assembled lipid tubules until exhaustion of the plating bath, as evidenced by cessation of bubbling. The metal microcylinders are electrically conductive and/or magnetically sensitive and are typically devoid of the lipid which was used to make the lipid tubules.

The initial step in the process is dissolution of a diacetylenic lipid in a solvent for the lipid. If heating is resorted to for solubilization, the temperature must be such as to avoid thermal degradation of the lipid. Typically, a lower alkyl alcohol, such as ethanol, is used to solubilize the lipid at room temperature. In order to avoid the preliminary purification, the lipid is initially dissolved in a solvent at a temperature of about 60–70° C., which is above the transition temperature, and the lipid material that either does not dissolve or that forms a syrup layer is removed, as by filtration and/or decantation of the dissolved lipid. The dissolved lipid is added to fresh solvent containing water and held at or incubated at an elevated temperature above the transition temperature for a period exceeding a quarter of one hour to many hours, or overnight, and then slowly cooled to room temperature over a period of many hours to allow for self-assembly of the lipid into tubules. The presence of water with the solvent allows for self-assembly of the lipid. During cooling, the dissolved lipid is agitated, as by inversion of its container once or twice a day. With some lipid batches, a solid precipitate forms at the bottom of the container during the incubation or cooling periods. This solid precipitate is also removed, as by filtering the tubules through a filter.

In a particular case, a volume of 20 liters of 70% ethanol, i.e., a solution consisting of 70% ethanol and 30% deionized water, on volume basis, was prepared in a container from 95% ethanol. One liter of 95% ethanol was placed into a separate flask and 100 g of technical grade as received diacetylenic lipid, i.e., 1,2-bis(10,12 tricosadiynoyl)-sn-glycero-3-phosphocoline, was added thereto and heated to 60–70° C. until the lipid dissolved, which took about 15 minutes. Material that did not dissolve or formed a syrup layer was rejected by filtering and or decanting the dissolved lipid. The dissolved lipid was added to the remainder 19 liters of the 70% ethanol and held at 60° C. overnight. Thereafter, the temperature was reduced to 45° C. and then at one degree per day to room temperature. The slow cooling of the dissolved lipid took 20 days and facilitated self-assembly of the lipid into tubules. The container, containing the lipid dissolved in the 20 liters of the 70% ethanol, was agitated by inverting it once or twice a day. A solid precipitate formed at bottom of the container. The precipitate was also rejected or removed by filtering the lipid tubules through a wire mesh.

After formation by self-assembly, the tubules are collected by centrifugation or allowed to settle by gravity and the supernatant is decanted resulting in a tubule dispersion in a water/solvent liquid of reduced volume. The volume reduction is typically 75–85%. The reduced volume of the tubule dispersion is dialyzed against water several times over a period of several days at room temperature in order to replace the solvent with water. On dialysis, the volume of the tubule dispersion typically increases due to swelling of the dialysis tubing. After dialysis, typically have 50–100 g of lipid tubules in 1–20 liters of water. After completing dialysis, tubules are again collected and dispersed in several liters of water. The tubules at this stage are not robust, i.e., not strong enough to retain their structure upon removal from the liquid they are in and collapse upon removal from the liquid.

In a particular case, the tubules were allowed to settle by gravity and the supernatant was decanted leaving a reduced volume of 3–5 liters of tubule dispersion, i.e., the tubules in the 70% ethanol. The tubule dispersion, which was clear, was dialyzed against water half a dozen times over a period of three days at room temperature to replace ethanol with water. The volume of the tubule dispersion about doubled due to swelling of the dialysis tubing.

Pre-metallization of the tubules in water involves addition of a crystalline salt to reduce pH of the clear tubule dispersion to the acid side followed by addition of a Pd—Sn catalyst, which is in the form of a brown liquid. The salt functionalizes the tubule surfaces and prepares them for the catalyst and the catalyst activates charged tubule surfaces for metal deposition. After addition of the salt and the catalyst, what results is a brown suspension which is held for a period of time of one quarter of one hour to overnight, or about 16 hours. During the holding phase, the tubules absorb the catalyst and become brown while the liquid portion of the suspension becomes clear. At this stage, a series of washes with deionized water is carried out to remove excess catalyst and the salt. The washings are continued until traces of the brown color are removed and then additional washings are made to remove any remaining traces of the catalyst and the salt. For purposes of distinction, after absorption of the catalyst by the tubules, the tubule dispersion is referred to herein as the tubule suspension, although a dispersion and a suspension have similar chemical connotations.

To determine amount of the lipid in the suspension, a small aliquot of the suspension is removed and dried. This is done in this fashion since drying destroys the lipid tubule structure.

In a particular case, the salt was Shipley's Cataprep 404 and amount of the salt added to the tubule dispersion with mixing was 270 grams per liter of the dispersion, the dispersion containing 30 grams of lipid tubules per liter of the dispersion. Before addition of the salt, pH of the dispersion was about 7 or neutral and after addition of the salt, it was about 4. Following this, the Pd—Sn catalyst, i.e., Shipley's Cataposit 44, was added slowly to a final concentration of 0.9% by volume. After addition of the catalyst, the tubules were allowed to settle overnight and became brown by absorption of the catalyst. The supernatant was discarded each day and additional water was added until the supernatant became clear of detectable brown color and then continued for additional three days. The washes were checked for completeness empirically by testing the batch in a plating bath. The generation of large amounts of debris in the plating bath is evidence of incomplete washing. The washed catalyzed tubules were stored in water at room temperature.

Electroless plating of the lipid tubules is conducted using conventional commercial metallization reagents. The plating bath is prepared by adding with mixing to a vessel water, metallization reagents and the suspension containing lipid tubules which were pretreated with the salt and the catalyst. Sufficient amounts of the metallization reagents must be added to obtain a metal coating of sufficient thickness to make the tubules electrically conducting and robust. The lipid tubules in the plating bath before plating is commenced are brown and the liquid in the bath corresponds to the color of the metallization reagents, which is blue in the case of copper metallization. Typically, 0.75–1 gram of lipid tubules is used per 10 liters of plating bath. The metallization reaction commences with spontaneous bubbling and continues until bubbling stops, indicating exhaustion of the plating bath. During plating, the tubules undergo a color change that depends on the color of the metal plated. Duration of the electroless plating is typically 1–4 hours at room temperature. Bubbling commences in about 5 minutes after all components are placed into the bath.

Any electrically conducting or ferromagnetic metal or both can be deposited on the tubules and its thickness should be sufficient to render the tubules electrically conducting and/or magnetically effective. Thus, by plating on the tubules an electrically conducting metal, such as copper, highly electrically conducting tubules can be formed. However, by plating on the tubules a magnetic metal, such as nickel, tubules of low electrical conductivity but of high magnetism can be obtained. By plating both an electrically conducting metal and a magnetic metal, tubules can be produced with high electrical conductivity and high magnetism. In order to deposit sufficient thickness of the metal, plating is prolonged until bubbling stops, indicating exhaustion of the bath.

In a particular case, an electroless or chemical copper plating bath was composed of 8 liters of deionized water with 1 liter of each of Shipleys Cuposit 328 A and 328Q metallization reagents. A 10-liter blue bath was used to plate almost 1.0 g of catalyzed tubules. The bath was subjected to occasional stirring during plating. Reaction in the bath was commenced with bubbling and proceeded until the bath was exhausted, as evidenced by the loss of the blue color conferred to it by presence of copper ions and cessation of gas generation or bubbling. After completion of plating, the tubules were collected by filtration and washed several times with water to remove the plating liquid.

If overplating is desired to deposit another coat of metal, it can be done at this point by collecting the tubules and placing them into another plating bath containing metallization reagents which deposit the desired metal and the plating operation is repeated to deposit a coating of another metal on the initial metal coat.

Overplating can be used to advantage here. The first coat can be electrically conductive making the tubules electrically conductive whereas it may be desired to render the tubules also magnetically sensitive. This can be achieved by plating a coating of another metal which renders the tubules magnetically sensitive. In such a case, the result is tubules which are not only electrically conductive but are also magnetically sensitive. Another reason for overplating metallized tubules is for the protection which the initial metal coating confers. After initial plating, it may be desired to overcoat metallized tubules at a temperature above or below the initial plating carried out at room temperature. Overplating may also be resorted to for the reason that a subsequent metal coat is incompatible with the lipid disposed below the initial metal coat.

Metallized tubules are then washed with a solvent for lipid, such as a lower alkyl alcohol, in order to remove lipid and convert the tubules to metal microcylinders which typically have an aspect ratio of less than the lipid tubules. Removal of the lipid is apparently effected through the breaks in the metal coating on the tubules or through the open ends of the tubules or some other way and results in a free-flowing product after removal of most or all of the sticky lipid. Reduction of the aspect ratio of the metal microcylinders as compared to the tubules resides in the fact that there is considerable breakage of the tubules during metallization.

In a particular case, after metallization, the tubules were collected by filtration of the plating bath and then washed three times with about 2 liters water to remove traces of the plating bath. This was followed by washings with about 2 liters methanol three times to dissolve and remove the lipid and then with about 2 liters of acetone for dehydration purposes. The product was dried under flowing nitrogen and heated in a container in a hot water bath. After drying, the product was a fine, free-flowing powder of individual robust metal microcylinders which was stored in a nitrogen atmosphere at room temperature.

Length of the metal microcylinders produced from the DC-8,9-PC diacetylenic lipid, as described herein, is shown in FIG. 2A which shows the length varying from less then 10 to 80$\mu$, with majority of the microcylinders being 10–40$\mu$, with the weight average length of about 20$\mu$. Width or outside diameter is shown in FIG. 2B where width is shown as varying from about 1 to about 3.5$\mu$, with majority of the microcylinders having width between about 1$\mu$ and about 2.5$\mu$, and the weight average width being about 1.5$\mu$. Wall thickness is also a variable, as shown in FIG. 2C, where it is shown as varying from about 0.1$\mu$ to about 0.5$\mu$, with most of the microcylinders having wall thickness of about 0.2 to about 0.4$\mu$, and the weight average wall thickness being about a quarter of a micron.

Figure 2D:
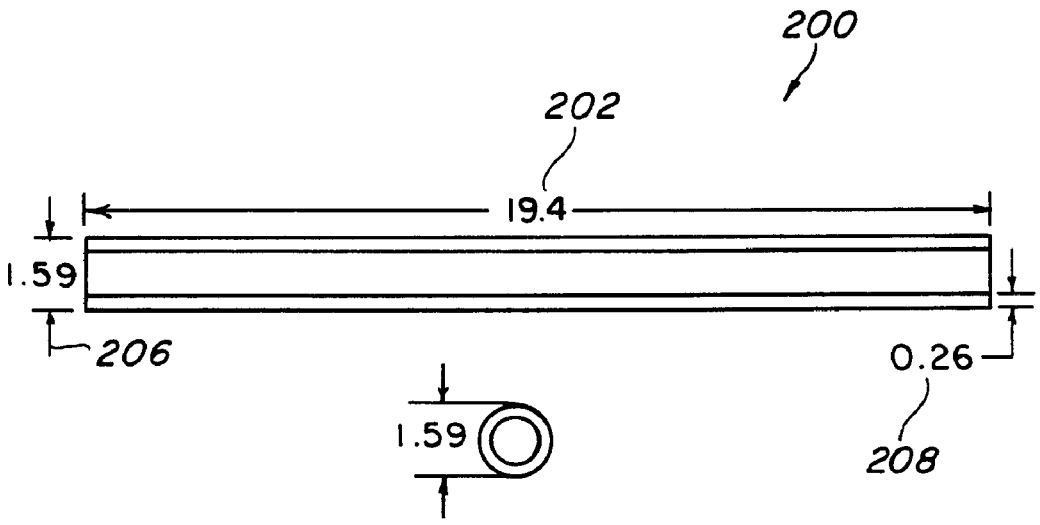
FIG. 2 is a graph of the metal microcylinders after dehydration and drying, showing length in FIG. 2A and width or outside diameter in FIG. 2B, determined by scanning electron microscopy, wall thickness in FIG. 2C, determined by transmission electron microscopy, and an ideal hypothetical metal microcylinder of this invention FIG. 2D.

FIG. 2D shows dimension of a hypothetical ideal hollow metallic microcylinder 200 having length 202 of 19.4$\mu$, width or outside diameter 206 of 1.59$\mu$, and wall thickness 208 of 0.26$\mu$. Based on micrographs of the tubules, wall 208 is hollow due to the fact that the lipid which formed the lipid tubule was removed by washing with a solvent. The hollow ring in the microcylinder wall, formed by removal of the lipid after metallization, is a fraction of the wall thickness and is estimated to be on the order of 0.01$\mu$ when present.

It should be understood that depiction of the hypothetical metal microcylinder in FIG. 2D is idealized and actual metal microcylinders are far removed from what is shown in FIG. 2D. For instance, actual metal microcylinder have a length that is far removed from the 19.4$\mu$, as evident from FIG. 2A.

While presently preferred embodiments have been shown of the novel method and product, and of the several modifications discussed, persons skilled in this art will readily appreciate that various changes and modifications may be made without departing from the spirit of the invention as defined and differentiated by the following claims.

What is claimed is:

1. Hollow electrically conducting and/or magnetic metal microcylinders in the form of free-flowing powder, said microcylinders comprising length of about 10 to 80$\mu$, outside diameter of from about 1 to 3.5$\mu$, and wall thickness of from about 0.1 to 0.5$\mu$.

2. The microcylinders of claim 1 having aspect ratio of about 12 wherein average length is about 20$\mu$ and average wall thickness is about a quarter of a micron and each of the microcylinders is hollow.

3. The microcylinders of claim 1 having a layer of another metal over the metal surfaces of said microcylinders.

* * * * *